US005127582A

United States Patent [19]

Roberts

[11] Patent Number: 5,127,582

[45] Date of Patent: Jul. 7, 1992

[54] NOZZLES FOR ROTARY AGITATORS

[75] Inventor: R. Lee Roberts, Boothwyn, Pa.

[73] Assignee: Roberts Filter Manufacturing Company, Darby, Pa.

[21] Appl. No.: 616,558

[22] Filed: Nov. 21, 1990

[51] Int. Cl.[5] ..... B05B 1/14

[52] U.S. Cl. ..... 239/553.3; 239/568; 239/DIG. 12

[58] Field of Search ..... 239/550, 553, 553.5, 239/568, 251, 142, DIG. 12, 533.13, 533.14, 553.3, 570, 722, 602, 254

[56] References Cited

U.S. PATENT DOCUMENTS

| | | | |
|---|---|---|---|
| 2,856,236 | 10/1958 | Hunziker | 239/568 |
| 2,941,544 | 6/1960 | Peras | 239/533.14 |
| 3,104,063 | 9/1963 | Bete | 239/568 |
| 3,150,832 | 9/1964 | Soth | 239/533.13 |
| 3,199,787 | 8/1965 | Oishei et al. | 239/533.13 |
| 3,288,297 | 11/1966 | Stuart | 239/254 |
| 3,351,292 | 11/1967 | Stuart, Sr. | 239/533.13 |
| 3,412,863 | 11/1968 | Stuart, Sr. | 239/254 |
| 3,675,850 | 7/1972 | Ebert | 239/254 |
| 4,099,494 | 7/1978 | Goloff et al. | 239/533.13 |
| 4,869,431 | 9/1989 | Jubert et al. | 239/533.13 |
| 5,005,737 | 4/1991 | Rohr | 239/533.13 |

*Primary Examiner*—Andres Kashnikow
*Assistant Examiner*—Lesley D. Morris
*Attorney, Agent, or Firm*—Caesar, Rivise, Bernstein, Cohen & Pokotilow, Ltd.

[57] ABSTRACT

Nozzles for use on a rotary agitator of a water and/or waste water filter system have an outer housing including a rear section through which the nozzle is connectable to the rotary agitator, and a forward wall including a plurality of ports therethrough. Fluid passage means extend from the rear connecting means to the ports for transmitting fluid from the agitator through the ports.

16 Claims, 2 Drawing Sheets

NOZZLES FOR ROTARY AGITATORS

FIELD OF THE INVENTION

This invention relates generally to nozzles through which fluids are directed, and more particularly to nozzles employed in rotary agitators of water and/or waste water filter systems.

BACKGROUND ART

It is common practice in water and/or waste water filter systems to employ a rotary agitator or sweep adjacent the upper surface of a particulate filter bed, to assist in the cleaning of the filter bed during a backwashing operation. These agitators include an elongated, rotary arm disposed in a horizontal plane and including a plurality of nozzles connected thereto along its axial length, for directing fluid from the rotary arm at a high velocity into engagement with particles of a filter bed.

It is quite common in the above described rotary sweeps to include nozzles at the axial ends of the rotary arm, to directed fluid into in engagement with filter bed particles in regions of the filter located radially outwardly from the rotary arm. In sweeps employing only one nozzle at each axial end of the rotary arm, a threaded rear end of the nozzle has been threaded into each respective end of the arm.

In sweeps including multiple end nozzles a short section of pipe has been provided with an opening through the peripheral wall thereof, and then welded perpendicular to the axial end of the rotary arm, with the opening through the peripheral wall of the short section of pipe aligned with the central passageway through the rotary arm. This short section of pipe formed a T-shaped plenum chamber, which has been tapped to accommodate a plurality of individual nozzles. This arrangement is undesirably complex, involving the assembly of a large number of components, including the individual components of each of the separate nozzles.

A prior art nozzle utilized in rotary sweeps is disclosed in U.S. Pat. No. 3,351,292 issued to Stuart, Sr. In this construction a cap member is provided with a single X-shaped incision aligned with a central passageway through a rear section of the nozzle, A forward wall of the rear nozzle section functions to engage lips provided by the X-shaped incision through the cap member to prevent the lips from moving inwardly when flow through the nozzle is interrupted, and thereby prevent foreign debris, such as debris collected by the filter bed, from entering and clogging the nozzle. An important feature of this invention is to locate the X-shaped incision in alignment with the central flow passageway through the rear section of the nozzle.

OBJECTS OF THE INVENTION

It is an object of this invention to provide nozzles for rotary sweeps which are simple in design, reliable in operation, and easy to construct.

It is a further object of this invention to provide nozzles through which a plurality of fluid jets are directed, but without requiring the use of separate nozzles for each such jet.

It is a further object of this invention to provide nozzles for use on rotary sweeps of water and/or waste water filter systems, and which are designed to prevent particulate material of a filter bed from entering the sweep.

SUMMARY OF THE INVENTION

The above and other objects of this invention are achieved in nozzles for use on a rotary agitator of a water and/or waste water filter system, wherein the nozzles include an outer housing having a rear connecting means for connecting the nozzles to the rotary agitator, and a forward wall including a plurality of ports therethrough. Fluid passage means extend from the rear connecting means to the ports for transmitting fluid from the agitator through said ports.

In the preferred embodiment of the invention the fluid passage means includes an elongate, linear passageway extending in a forward direction from the rear connecting means toward the forward wall, and a plenum chamber communicating said linear passageway with the plurality of ports.

In a preferred embodiment of the invention the ports are spaced apart from each other over only a limited area of the forward wall, thereby leaving another area of said forward wall free of said ports. The passage means preferably includes a linear passageway having a central axis which intercepts the forward wall in said another area.

In the most preferred embodiment of the invention each of the ports has a central axis which is oriented parallel to the linear axis of the linear passageway through which fluid flows from the rotary agitator, the axis of each of said ports being inclined downwardly in a direction outwardly from said ports when said nozzle is attached to the agitator.

In the most preferred embodiment of the invention a ported member (e.g., a ported plate or porous screen) is disposed adjacent an inner surface of the forward wall for diffusing the flow of fluid from the agitator, prior to said fluid passing through the ports in the forward wall of the nozzle.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

DETAILED DESCRIPTION OF THE PREFERRED EMBODIMENT

Figure 1:
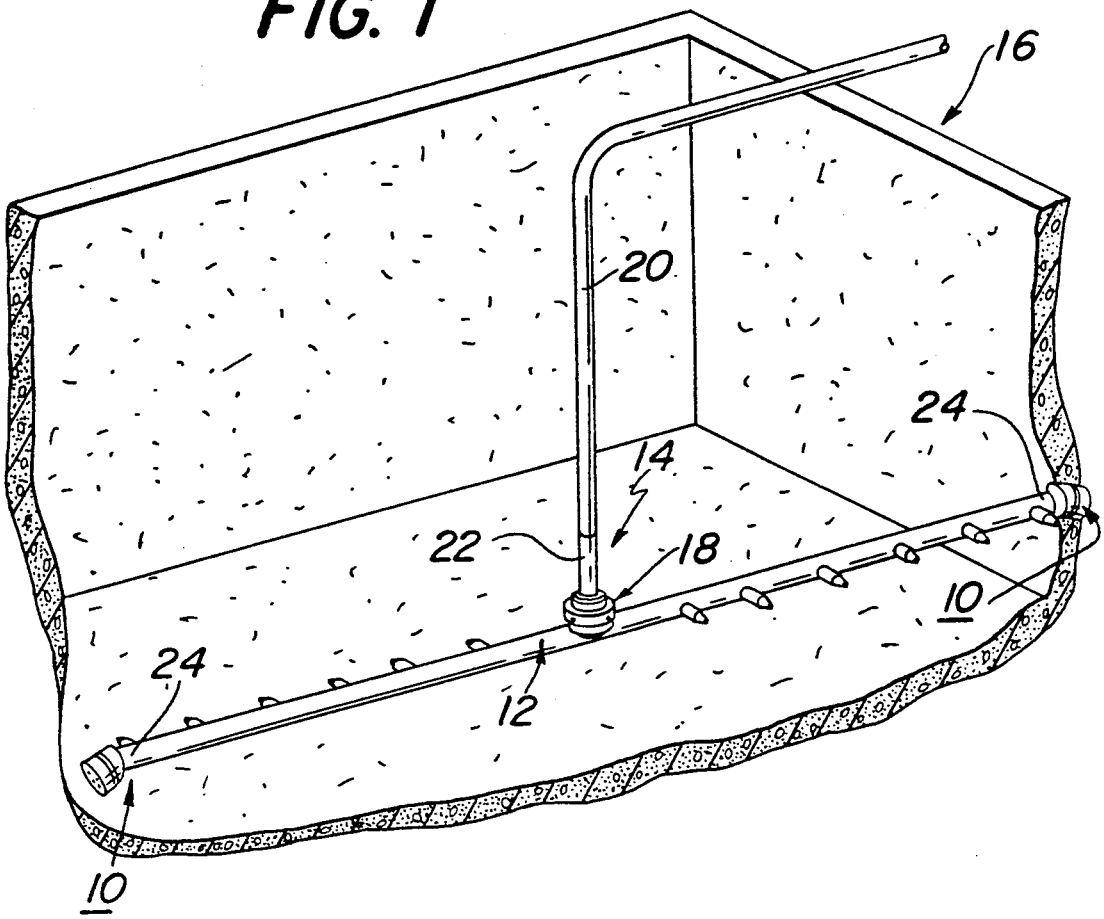
FIG. 1 is a fragmentary isometric view of a filter including a rotary sweep employing a unique nozzle construction of this invention, said filter being schematically shown to illustrate the environment of use of the invention.

Referring now in greater detail to the various figures of the drawings wherein like reference characters refer to like parts, a Nozzle embodying the present invention is generally shown at 10 in FIG. 1, one of said nozzles being attached at each axial end of an elongate, hollow, horizontal tubular member 12 constituting the rotatable arm of a rotary agitator 14. In the preferred mode of operation the rotary agitator 14 is employed in a water or waste water filter, which is schematically illustrated at 16.

As can be seen in FIG. 1, the rotary arm 12 of the agitator 14 is a single tubular member that is connected at its midpoint to a central bearing assembly 18. A down pipe 20, in the form of a hollow conduit, is threadedly secured to the threaded upper end of a hollow stator 22 of the bearing assembly. Although the overall design of the rotary agitator 14 does not constitute a part of the present invention, it should be noted that the preferred agitator 14 in which the nozzles 10 of this invention are employed forms the subject matter of copending patent application Ser. No. 616,557, titled ROTARY AGITATOR, filed on even date herewith, in the names of Donald John MacKay, Douglas Howard Eden and R. Lee Roberts, and assigned to Roberts Filter Manufacturing Company. However, it should be understood that the nozzles 10 of this invention can be used with a variety of rotary agitator designs.

Figure 4:
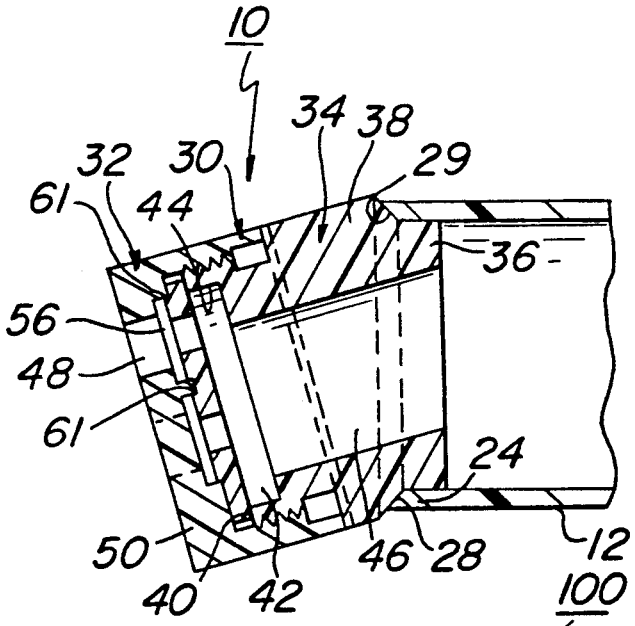
FIG. 4 is a sectional view taken along line 4—4 of FIG. 2.

Referring to FIGS. 1 and 4, the nozzles 10 are welded into opposed axial ends 24 of the rotary arm 12 at contiguous surfaces 28, 29 of each nozzle 10 and the rotary arm 12, respectively.

Figure 2:
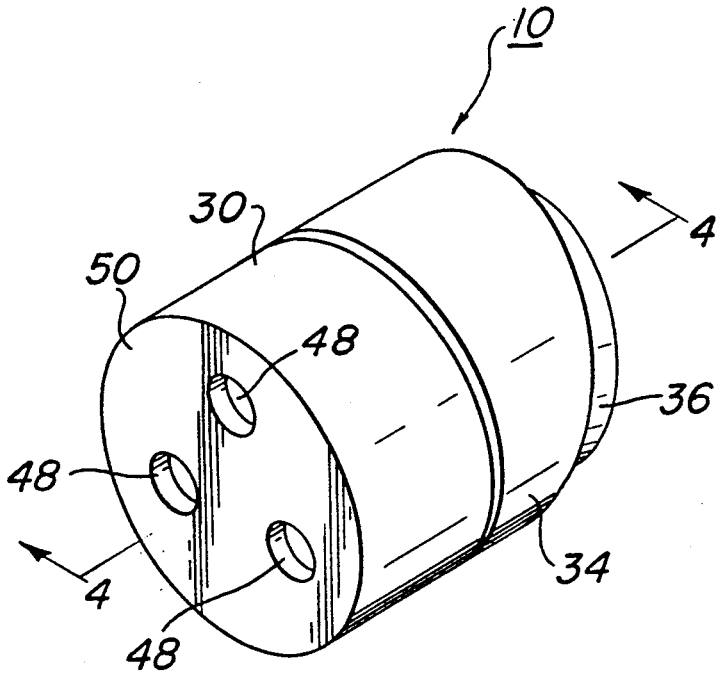
FIG. 2 is an isometric view of a nozzle construction in accordance with one embodiment of this invention.
Figure 3:
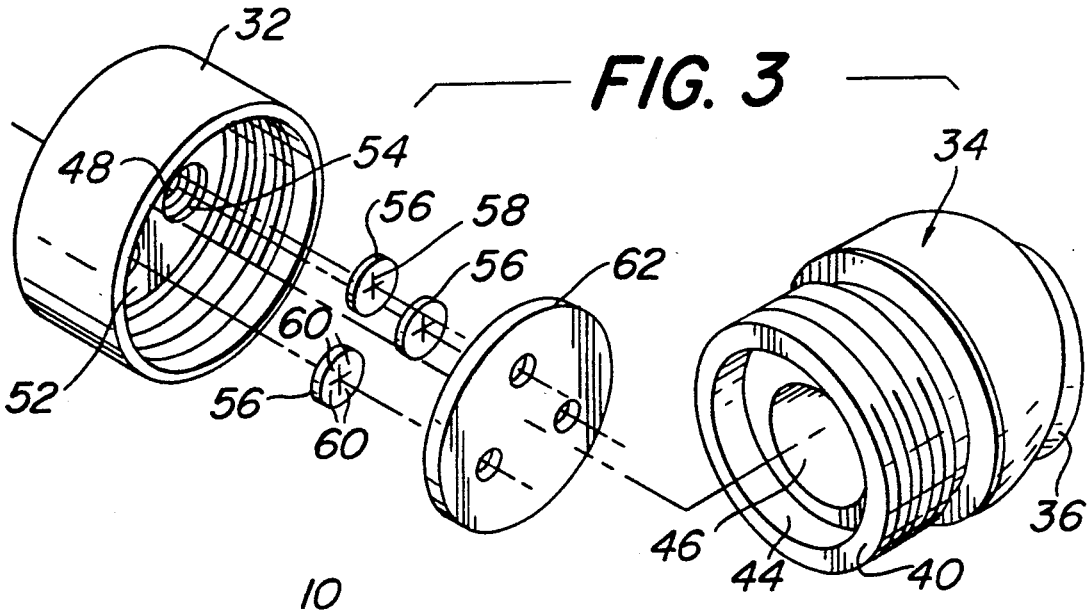
FIG. 3 is an exploded isometric view of the nozzle construction shown in FIG. 2.

Referring to FIGS. 2–4, the nozzle 10 of this invention includes a two-part outer housing 30 provided by a forward, or downstream, cap section 32 threadedly attached to a rear, or upstream, hub section 34. The hub section 34 includes a rear nipple 36 integrally formed with a forward body portion 38. The body portion 38 has a forward wall 40 provided with a central recess 42 defined by a peripheral wall 44. This central recess 42 constitutes a plenum chamber for fluid directed through the nozzle 10, as will be described in detail hereinafter. As can be seen best in FIG. 4, an elongate, linear passageway 46 extends through the hub section 34 and communicates with the plenum 42.

Referring to FIGS. 2 and 3, the cap section 32 of the outer housing 30 includes a plurality of ports (e.g., three), in the form of open passages 48, extending through a forward wall 50 of said cap section. The inner surface 52 of the forward wall 50 is countersunk at 54 in the region of each passage 48 to receive flexible discs 56 made of gum rubber or other suitable material.

Each of the flexible discs 56 is provided with an X-shaped incision 58 therethrough to form a plurality of lips 60 which yield outwardly or forwardly (not shown) under the influence of fluid pressure passing through the nozzle 10.

The plurality of discs 56 are held in proper position relative to the passages 48 by being sandwiched between the inner surface of countersunk regions 54 in the forward wall 50 of the cap section 32 and hub sections 61 of a porous member in the form of a ported plate 62. Specifically, the forward wall 40 of the body section 34, when threadedly attached to the cap section 32, presses the plate 62 forwardly to thereby force the hub sections 61 into engagement with the discs 56, which are disposed in the countersunk regions 54.

A very desirable feature of this invention is that the central axis of the linear passageway 46 is not aligned with any of the ports 48. In particular, the ports 48 are spaced apart from each other at equal distances. The center of the forward wall 50 is free of fluid ports or openings, and the central axis of the linear passageway 46 intersects this center of the forward wall. As a result of this arrangement the fluid passing through the linear passageway 46 from the rotary arm 12 distributes itself within the plenum chamber provided by the recess 42 before building up sufficient internal pressure to force the lips 60 of the discs 56 outwardly or forwardly into an open position, to thereby permit a high velocity, substantially uniform flow of fluid through all of the aligned ports 48. In this regard the ported plate 62 also aids to unify the flow of the fluid, so that the fluid pressure imposed upon each of the discs 56 will be substantially the same.

Figure 6:
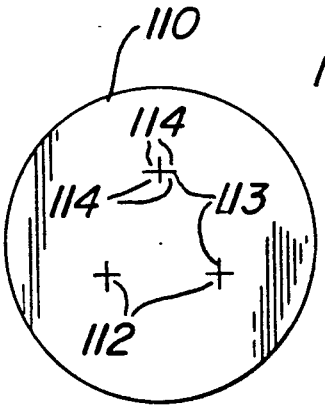
FIG. 6 is an end elevational view along line 6—6 of FIG. 5.
Figure 5:
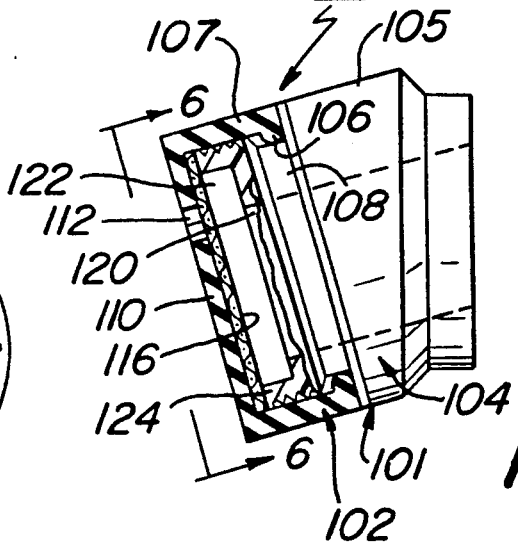
FIG. 5 is a side elevational view, partly in section, showing a nozzle construction in accordance with a second embodiment of this invention.

Referring to FIGS. 5 and 6, a second embodiment of a nozzle in accordance with this invention is generally shown at 100. This nozzle 100 has a number of features which are similar to the nozzle 10. However, the primary difference relates to the manner in which the plurality of ports are provided through the cap section 102.

As can be seen best in FIG. 5, the nozzle 100 has a two-part outer housing 101 including a forward cap section 102 secured to a rear hub section 104. The cap section is made of an elastomeric material, and is maintained on a forward body portion 105 of the rear hub section 104 by the engagement of an inwardly directed annular rib 106 on the peripheral side wall 107 of the cap section within an annular recess 108 formed in the hub section 104. It should be noted that although the hub section 104 can have a threaded forward end, as is illustrated, the threads are not required in this embodiment because they are not relied upon to retain the cap section 102 on the hub section. However, by including the threads on the forward end of the hub section 104, this same hub section can be employed to form a nozzle with a threaded cap section, such as the nozzle 10 of the first embodiment of this invention.

As in the nozzle 10, the cap section 102 has a forward wall 110 provided with a plurality of ports 112 therethrough. However, in the nozzle 100, as can be seen best in FIG. 6, each of the ports is provided by a X-shaped incision 113 to form confronting lips 114 which normally are in a closed condition, but which are biased outwardly or forwardly (not shown) under the influence of fluid pressure to provide openings through which high velocity flow of fluid can pass. It should be noted that the forward wall 110 of the cap section 102 is thinner than the peripheral side wall 107 of said cap section, to thereby permit the required movement of the lips 114 to take place. On the other hand, it is important that the peripheral side wall 107 of the cap section 102 be fairly rigid, so that fluid pressure imposed against the inner surface of the forward wall 110 will not cause the annular rib 106 to inadvertently separate from its engagement within the annular recess 108 of the hub section 104. However, the peripheral side wall 107 must have some flexibility, so that it can be snap-fit into locking engagement with the hub section 104.

It should be apparent that in the nozzle 100 separate discs with X-shaped incisions, such as the discs 56 employed in the nozzle 10, are not needed or utilized. The ports 112 actually provide the same function as provided by the discs 56, namely, preventing particles from the filter bed or other foreign debris from entering the rotary agitator assembly during periods of time when high pressure fluid is not being directed through the agitator.

As can be seen best in FIG. 5, the nozzle 100 includes a porous member in the form of a porous screen 116, which is similar to the ported plate member 62 employed in the nozzle 10. The screen member 116 tends to unify the fluid pressure imposed upon the lips 114 forming the ports 112, to thereby establish uniform, high velocity flow of fluid through all of the ports 112.

Still referring to FIG. 5, an elongate passageway 120 extends through the hub section 104, and is identical in function and orientation to the passageway 46 in the nozzle 10. In particular, like the passageway 46, the central axis of the passageway 120 intersects the semi-annular section of the forward wall 110 that is free of ports 112. Also, like the passageway 46, the passageway 120 communicates with a recess or plenum chamber 122 formed in the forward wall 124 of the body portion of the hub section 104.

In both the nozzles 10 and 100 the central axes of the body portions 38, 105 are at slight acute angles alpha ($\alpha$) of approximately 15 degrees to the central axis of the nipple 36. The central axes of the ports 48, 112 and the elongated passages 46, 120 are substantially parallel to the central axes of the body portions 38, 105, and accordingly, are also at the same slight acute angle to the central axis of the nipple 36 integrally formed with the forward body portions 38, 104. As a result of this geometric arrangement of elements, the central axes of the ports 48, 112 extend outwardly of the nozzles 10 and 100 in a downward direction when the nozzles are secured to the rotary arm 12 of the rotary agitator 14, with the elongate passageways 46, 120 coaxial with the elongate passageway through the rotary arm 12. This arrangement directs fluid flow in a downward direction into the filter bed to aid in cleaning the surface layer of the bed during backwashing of the filter 16.

Without further elaboration, the foregoing will so fully illustrate my invention that others may, by applying current or future knowledge, adopt the same for use under various conditions of service.

What is claimed as the invention is:

1. A nozzle for use on a rotary agitator of a water and/or waste water filter system, said nozzle comprising an outer housing having a rear section through which the nozzle is connectable to the rotary agitator, and a forward wall, said forward wall including a plurality of ports therethrough, fluid passage means extending from said rear section to said ports for transmitting fluid from the agitator through said ports, said fluid passage means including an elongate, linear passageway extending in a forward direction from the rear section toward said forward wall, and a plenum chamber communicating said linear passageway with said plurality of ports, said linear passageway having a central axis and each of said ports having a central axis, the central axis of the linear passageway being oriented parallel to the linear axis of each of said ports, the axis of each of said ports inclining downwardly in a direction outwardly from said ports when said nozzle is attached to the rotary agitator.

2. A nozzle for use on a rotatory agitator of a water and/or waste water filter system, said nozzle comprising an outer housing including a rear hub section and a separate cap section connected to the hub section, said rear hub section including a rear section to which the nozzle is connectable to the rotary agitator, said cap section including a flexible forward wall and a plurality of ports therethrough, each of said ports being provided by crossing slits in said forward wall, said crossing slits creating lip means movable away from each other to provide openings through which fluid is directed from the agitator, said rear hub section including fluid passage means extending from said rear section to said ports for transmitting fluid from the agitator through said ports, said ports being spaced-apart from each other over only a limited area of the forward wall, thereby leaving another area of said forward wall free of said ports, said fluid passage means including an elongate, linear passageway extending in a forward direction from the rear section toward the forward wall, said linear passageway having a central axis which intercepts the forward wall in said another area.

3. A nozzle for use on a rotary agitator of a water and/or waste water filter system, said nozzle comprising an outer housing having a rear section through which the nozzle is connectable to the rotary agitator, and a forward wall, said forward wall including a plurality of ports therethrough, fluid passage means extending from said rear section to said ports for transmitting fluid from the agitator through said ports, said fluid passage means including an elongate, linear passageway extending in a forward direction from the rear section toward said forward wall, said linear passageway having a central axis and each of said ports having a central axis, the central axis of the linear passageway being oriented parallel to the linear axis of each of said ports, the axis of each of said ports inclining downwardly in a direction outwardly from said ports when said nozzle is attached to the rotary agitator.

4. A nozzle for use on a rotary agitator of a water and/or waste water filter system, said nozzle comprising an outer housing having a rear section through which the nozzle is connectable to the rotary agitator, and a forward wall, said forward wall including a plurality of ports therethrough, fluid passage means extending from said rear section to said ports for transmitting fluid from the agitator through said ports, each of said ports being provided by crossing slits in said forward wall, said crossing slits creating lip means movable away from each other to provide openings through which fluid is directed from the agitator, said ports being spaced-apart from each other over only a limited area of the forward wall, thereby leaving another area of said forward wall free of said ports, said fluid passage means including an elongate, linear passageway extending in a forward direction from the rear section toward the forward wall, said linear passageway having a central axis which intercepts the forward wall in said another area.

5. A nozzle for use on a rotary agitator of a water and/or waste water filter system, said nozzle comprising an outer housing having a rear section through which the nozzle is connectable to the rotary agitator, and a forward wall, said forward wall including a plurality of ports therethrough, fluid passage means extending from said rear section to said ports for transmitting fluid from the agitator through said ports, each of said ports including a peripheral wall defining an opening, said nozzle further including a disc means disposed rearwardly of and aligned with each of said openings, each disc means including crossing slits creating lip means, said lip means being movable away from each other to provide an opening in said disc in alignment with an opening in the forward wall to provide a passageway through which fluid is directed from the agitator.

6. The nozzle of claim 4, including a porous member disposed adjacent an inner surface of the forward wall for diffusing the flow of fluid from the agitator, prior to said fluid passing through said ports.

7. The nozzle of claim 5, including a porous member disposed adjacent an inner surface of the forward wall for diffusing the flow of fluid from the agitator, prior to said fluid passing through said ports, said porous member assisting in maintaining the discs in aligned position with respective openings through the forward wall.

8. The nozzle of claim 6, wherein said fluid passage means includes an elongate, linear passageway extending in a forward direction from the rear section toward said forward wall, and a plenum chamber communicating said linear passageway with said porous member and said plurality of ports.

9. The nozzle of claim 8, wherein said ports are spaced apart from each other over only a limited area of the forward wall, thereby leaving another area of said forward wall free of said ports, said linear passageway having a central axis, said central axis intercepting the forward wall in said another area.

10. The nozzle of claim 8, wherein said linear passageway has a central axis and each of said ports has a central axis, the central axis of the linear passageway being oriented parallel to the central axis of each of said ports, the axis of each of said ports inclining downwardly in a direction outwardly from said ports when said nozzle is attached to the rotary agitator.

11. The nozzle of claim 7, wherein said fluid passage means includes an elongate, linear passageway extending in a forward direction from the rear section toward said forward wall, and a plenum chamber communicating said linear passageway with said porous member and said plurality of ports.

12. The nozzle of claim 11, wherein said ports are spaced apart from each other over only a limited area of the forward wall, thereby leaving another area of said forward wall free of said ports, said linear passageway having a central axis, said central axis intercepting the forward wall in said another area.

13. The nozzle of claim 11, wherein said linear passageway has a central axis and each of said ports has a central axis, the central axis of the linear passageway being oriented parallel to the central axis of each of said ports, the axis of each of said ports inclining downwardly in a direction outwardly from said ports when said nozzle is attached to the rotary agitator.

14. A nozzle for use on a rotary agitator of a water and/or waste water filter system, said nozzle comprising an outer housing including a rear hub section and a separate cap section connected to the hub section, said rear hub section having a rear section through which the nozzle is connectable to the rotary agitator, said cap section including a forward wall through which a plurality of ports extend, fluid passage means extending from the rear section to said ports for transmitting fluid from the agitator to said ports, said fluid passage means including an elongate, linear passageway extending in a forward direction in the rear section, from the rear section toward said forward wall, said linear passageway communicating with a plenum chamber in a forward end of the rear hub section, said plenum chamber communicating said linear passageway with said plurality of ports in said cap section.

15. A nozzle for use on a rotary agitator of a water and/or waste water filter system, said nozzle comprising an outer housing including a rear hub section and a separate cap section connected to the hub section, said rear hub section having a rear section through which the nozzle is connectable to the rotary agitator, said cap section including a forward wall through which a plurality of ports extend, fluid passage means extending from the rear section to said ports for transmitting fluid from the agitator through said ports, further including a porous member disposed adjacent an inner surface of the forward wall of the cap section for diffusing the flow of fluid from the agitator, prior to said fluid passing through said ports, said porous member being pressed into engagement with the forward wall of the cap section by a forward surface of the hub section.

16. A nozzle for use on a rotatory agitator of a water and/or waste water filter system, said nozzle comprising an outer housing including a rear hub section and a separate cap section connected to the hub section, said rear hub section including a rear section through which the nozzle is connectable to the rotary agitator, said cap section including a forward wall through which a plurality of ports extend, fluid passage means extending from the rear section to said ports for transmitting fluid from the agitator to said ports, each of said ports including a peripheral wall defining an opening, said nozzle further including a disc means disposed rearwardly of and aligned with each said opening, each disc means including crossing slits creating lip means, said lip means being moveable away from each other to provide an opening in said disc in alignment with an opening in the forward wall to provide a passageway through which fluid is directed from the agitator.

* * * * *